US009850733B2

(12) United States Patent
Fripp et al.

(10) Patent No.: US 9,850,733 B2
(45) Date of Patent: Dec. 26, 2017

(54) SELF-ASSEMBLING PACKER

(71) Applicant: HALLIBURTON ENERGY SERVICES, INC., Houston, TX (US)

(72) Inventors: Michael Linley Fripp, Carrollton, TX (US); Zachary Ryan Murphree, Dallas, TX (US); Thomas Jules Frosell, Irving, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 328 days.

(21) Appl. No.: 14/409,351

(22) PCT Filed: Dec. 19, 2013

(86) PCT No.: PCT/US2013/076456
§ 371 (c)(1),
(2) Date: Dec. 18, 2014

(87) PCT Pub. No.: WO2015/094266
PCT Pub. Date: Jun. 25, 2015

(65) Prior Publication Data

US 2015/0315868 A1 Nov. 5, 2015

(51) Int. Cl.
*E21B 23/00* (2006.01)
*E21B 33/12* (2006.01)
*E21B 33/10* (2006.01)

(52) U.S. Cl.
CPC ..... *E21B 33/12* (2013.01); *E21B 33/10* (2013.01); *E21B 33/1208* (2013.01)

(58) Field of Classification Search
CPC ..... E21B 41/00; E21B 23/00; E21B 33/13; E21B 33/12; E21B 33/134; F15B 21/065; H01F 1/447; C09K 2208/10
See application file for complete search history.

(56) References Cited

U.S. PATENT DOCUMENTS

| | | | |
|---|---|---|---|
| 3,984,918 | A | 10/1976 | Chaney |
| 4,035,718 | A | 7/1977 | Chandler |
| 4,350,955 | A | 9/1982 | Jackson et al. |
| 4,356,098 | A | 10/1982 | Chagnon |

(Continued)

FOREIGN PATENT DOCUMENTS

| | | |
|---|---|---|
| GB | 2222680 | 3/1990 |
| PL | 397294 | 6/2013 |

(Continued)

OTHER PUBLICATIONS

Australian Patent Application No. AU2013408286, Examination Report dated Jun. 15, 2016, 3 pages.

(Continued)

*Primary Examiner* — Kipp C Wallace
(74) *Attorney, Agent, or Firm* — Kilpatrick Townsend & Stockton LLP

(57) ABSTRACT

Certain aspects are directed to self-assembling packers that seal an annulus in a downhole wellbore. In one aspect, the packer is formed from a magnetorheological fluid, which may be a carrier fluid formed from a polymer precursor and magnetically responsive particles. The fluid is allowed to be shaped by a magnetic field provided by one or more magnets exerting a radially extending magnetic field from a tubing section used to place the packer.

14 Claims, 3 Drawing Sheets

(56) References Cited

U.S. PATENT DOCUMENTS 4,424,974 A 1/1984 Mitsuya et al.
4,444,398 A 4/1984 Black et al.
4,502,700 A 3/1985 Gowda et al.
4,526,379 A 7/1985 Raj
4,604,222 A 8/1986 Borduz et al.
4,604,229 A 8/1986 Raj et al.
4,630,243 A 12/1986 MacLeod
4,630,943 A 12/1986 Stahl et al.
4,691,774 A 9/1987 Nelson
4,802,534 A 2/1989 Larson et al.
4,845,988 A 7/1989 Russell et al.
4,865,334 A 9/1989 Raj et al.
4,991,438 A 2/1991 Evans
5,007,513 A 4/1991 Carlson
5,092,611 A 3/1992 Ehmsen et al.
5,346,011 A * 9/1994 Onan ..... C09K 8/424 166/153
5,429,000 A 7/1995 Raj et al.
5,452,520 A 9/1995 Raj et al.
5,474,302 A 12/1995 Black et al.
5,475,309 A 12/1995 Hong et al.
5,780,741 A 7/1998 Raj
5,850,624 A 12/1998 Gard et al.
6,216,787 B1 4/2001 Ruttley
6,250,848 B1 6/2001 Moridis et al.
6,257,356 B1 7/2001 Wassell
6,290,894 B1 9/2001 Raj et al.
6,305,694 B1 10/2001 Yamazumi et al.
6,681,849 B2 1/2004 Goodson, Jr.
6,817,415 B2 11/2004 Orban et al.
7,021,406 B2 4/2006 Zitha
7,032,670 B2 4/2006 Zitha
7,063,146 B2 6/2006 Schultz et al.
7,063,802 B2 6/2006 Tsuda et al.
7,159,675 B2 1/2007 Eigner et al.
7,204,581 B2 4/2007 Peeters
7,219,752 B2 5/2007 Wassell et al.
7,428,922 B2 9/2008 Fripp et al.
7,743,825 B2 6/2010 O"Malley et al.
7,763,175 B2 7/2010 DeCoster et al.
7,779,933 B2 8/2010 Sihler et al.
7,950,672 B2 5/2011 Shimazaki et al.
8,056,246 B1 11/2011 Hopper et al.
8,136,594 B2 * 3/2012 Streich ..... C09K 8/42 166/292
8,230,918 B2 7/2012 Ameen et al.
8,269,501 B2 9/2012 Schmidt et al.
8,286,705 B2 10/2012 Ocalan et al.
8,328,199 B2 12/2012 Oshita
8,360,170 B2 1/2013 Leuchtenberg
8,419,019 B2 4/2013 Kung
8,689,875 B2 4/2014 Dudley et al.
9,206,659 B2 12/2015 Zhang et al.
9,512,698 B2 12/2016 Donderici et al.
9,551,203 B2 1/2017 Stelzer et al.
2003/0166470 A1 9/2003 Fripp et al.
2004/0084184 A1 5/2004 Orban et al.
2005/0006020 A1 * 1/2005 Jose Zitha ..... C04B 40/0209 156/71
2005/0109512 A1 5/2005 Zitha et al.
2005/0274524 A1 * 12/2005 Silguero ..... E21B 37/00 166/311
2008/0290876 A1 11/2008 Ameen
2009/0008078 A1 1/2009 Patel
2009/0025928 A1 1/2009 Lee
2009/0101364 A1 * 4/2009 Schafer ..... E21B 33/1208 166/387
2009/0179385 A1 7/2009 Komino et al.
2010/0019514 A1 1/2010 Steinwender
2010/0126716 A1 5/2010 Joseph
2010/0187009 A1 7/2010 Siher et al.
2010/0224360 A1 9/2010 MacDougall et al.
2010/0267594 A1 10/2010 Rana et al.
2011/0056681 A1 3/2011 Khan
2011/0108277 A1 5/2011 Dudley et al.
2011/0186297 A1 8/2011 Zhang et al.
2011/0192573 A1 8/2011 Defretin et al.
2011/0297265 A1 12/2011 Kahoe et al.
2011/0297394 A1 12/2011 VanDelden
2013/0020066 A1 1/2013 Ocalan et al.
2013/0091941 A1 4/2013 Huh et al.
2013/0105224 A1 5/2013 Donderici et al.
2013/0112911 A1 5/2013 Mazyar et al.
2013/0119995 A1 5/2013 Wootten
2013/0139565 A1 6/2013 Hedtke
2013/0169278 A1 7/2013 Bittar et al.
2013/0199650 A1 * 8/2013 Cabot ..... E21B 33/06 138/89
2014/0239957 A1 8/2014 Zhang et al.
2014/0262268 A1 9/2014 Kageler
2015/0013985 A1 1/2015 Parsche
2015/0034332 A1 2/2015 Merron
2015/0345250 A1 12/2015 Murphree et al.
2016/0010424 A1 1/2016 Cowan et al.
2016/0032688 A1 2/2016 Donderici et al.
2016/0040506 A1 2/2016 Goodman et al.
2016/0040507 A1 2/2016 Donderici et al.
2016/0047204 A1 2/2016 Donderici et al.
2016/0145968 A1 * 5/2016 Marya ..... E21B 33/1208 166/386
2016/0290089 A1 10/2016 Neely et al.
2017/0037710 A1 2/2017 Richards

FOREIGN PATENT DOCUMENTS

WO 0161713 8/2001
WO 2005038189 4/2005
WO 2009142779 11/2009
WO 2011153524 12/2011
WO 2013012967 1/2013
WO 2015094266 6/2015
WO 2015094274 6/2015
WO 2015102561 7/2015
WO 2015102563 7/2015
WO 2015102566 7/2015
WO 2015102568 7/2015

OTHER PUBLICATIONS

Dickstein et al., "Labyrinthine Pattern Formation in Magnetic Fluids", Science, New Series, vol. 261, No. 5124, Aug. 20, 1993, pp. 1012-1015.
Gollwitzer et al., "The Surface Topography of a Magnetic Fluid—A Quantitative Comparison Between Experiment and Numerical Simulation", Journal of Fluid Mechanics, May 2006, pp. 1-21.
Grundfos , "The Centrifugal Pump", Company Datasheet, Dec. 2003.
Horak et al., "Experimental and Numerical Determination of the Static Critical Pressure in Ferrofluid Seals", Journal of Physics: Conference Series, vol. 412, 2013, pp. 1-6.
Pant et al., "Synthesis and characterization of ferrofluid-conducting polymer composite", Indian Journal of Engineering and Materials Sciences, vol. 11, Aug. 2004., pp. 267-270.
International Patent Application No. PCT/US2013/076456 , International Search Report and Written Opinion, dated Sep. 22, 2014, 13 pages.
Raj et al., "Advances in ferrofluid technology", Journal of Magnetism and Magnetic Materials, vol. 149, 1995, pp. 174-180.
Rosenweig , "Magnetic Fluid Motion in Rotating Field", Journal of Magnetism and Magnetic Materials, vol. 85, Issues 1-3, Apr. 1990, pp. 171-180.
Canadian Patent Application No. 2,927,574 , Office Action dated Dec. 13, 2016, 3 pages.

* cited by examiner

SELF-ASSEMBLING PACKER

CROSS-REFERENCE TO RELATED APPLICATIONS

This is a U.S. national phase under 35 U.S.C. 371 of International Patent Application No. PCT/US2013/076456, titled "Self-Assembling Packer" and filed Dec. 19, 2013, the entirety of which is incorporated herein by reference.

TECHNICAL FIELD OF THE DISCLOSURE

The present disclosure relates generally to devices for use in a wellbore in a subterranean formation and, more particularly (although not necessarily exclusively), to a self-assembling packer that may be used for creating zonal isolation through a gravel pack or other downhole configuration.

BACKGROUND

Various devices can be utilized in a well that traverses a hydrocarbon-bearing subterranean formation. In many instances, it may be desirable to divide a subterranean formation into zones and to isolate those zones from one another in order to prevent cross-flow of fluids from the rock formation and other areas into the annulus. There are in-flow control devices that may be used to balance production, for example, to prevent all production from one zone of the well. Without such devices, the zone may experience problems such as sand production, erosion, water breakthrough, or other detrimental problems.

For example, a packer device may be installed along production tubing in the well by applying a force to an elastomeric element of the packer. Expansion of the elastomeric element may restrict the flow of fluid through an annulus between the tubing and the formation or casing. Many packer devices are configured to be actuated, installed, or removed by a force applied to the device while the packer is disposed in the well. In one example, the force may be a hydraulic squeeze that causes the packer to squeeze and forces the elastomeric element to expand in response to the force. Expansion of the packer restricts the flow of fluid through the blocked area. In another example, a force may be applied to a removable plug device to withdraw the plug from an installed position in the wellbore. A further option has been to provide packers made of shape memory or material. When such a packer receives heat or other stimulus, it may cause the packer to soften under compression. When the heat or other stimulus is removed, the packer material may stiffen, which causes it to effectively seal the annulus around the tubing. Other packers have been made of swellable material, such that when the packer is exposed to water or oil or other substance(s), the packer will swell and fill the desired annulus.

DETAILED DESCRIPTION

Certain aspects and examples of the present disclosure are directed to self-assembling packers that may be deployed downhole in a well system. For example, there is provided a self-assembling packer that can be deployed downhole, even in gravel and other debris environment, and that can effectively be set and maintain the desired annulus seal. For example, some wells that traverse subterranean formations may be filled with gravel and other debris that can prevent a packer from creating the desired and proper seal. Packers that can create a zonal isolation through a gravel pack or that can be set in more aggressive and debris-filled environments would be useful. Accordingly, improved packers and ways to set them are provided.

The self-assembling packer can be formed in response to magnetic forces exerted by magnets that may be included within the delivery tubing, on the tubing, or otherwise near the location where the packer is to be formed. Forming the packer in response to magnetic forces exerted by magnets can allow a packer to be formed without a hydraulic squeeze or other force that is typically used to form a packer.

These illustrative examples are given to introduce the reader to the general subject matter discussed here and are not intended to limit the scope of the disclosed concepts. The following sections describe various additional aspects and examples with reference to the drawings in which like numerals indicate like elements, and directional descriptions are used to describe the illustrative aspects. The following sections use directional descriptions such as "above," "below," "upper," "lower," "upward," "downward," "left," "right," "uphole," "downhole," etc. in relation to the illustrative aspects as they are depicted in the figures, the upward direction being toward the top of the corresponding figure and the downward direction being toward the bottom of the corresponding figure, the uphole direction being toward the surface of the well and the downhole direction being toward the toe of the well. Like the illustrative aspects, the numerals and directional descriptions included in the following sections should not be used to limit the present disclosure.

Figure 1:
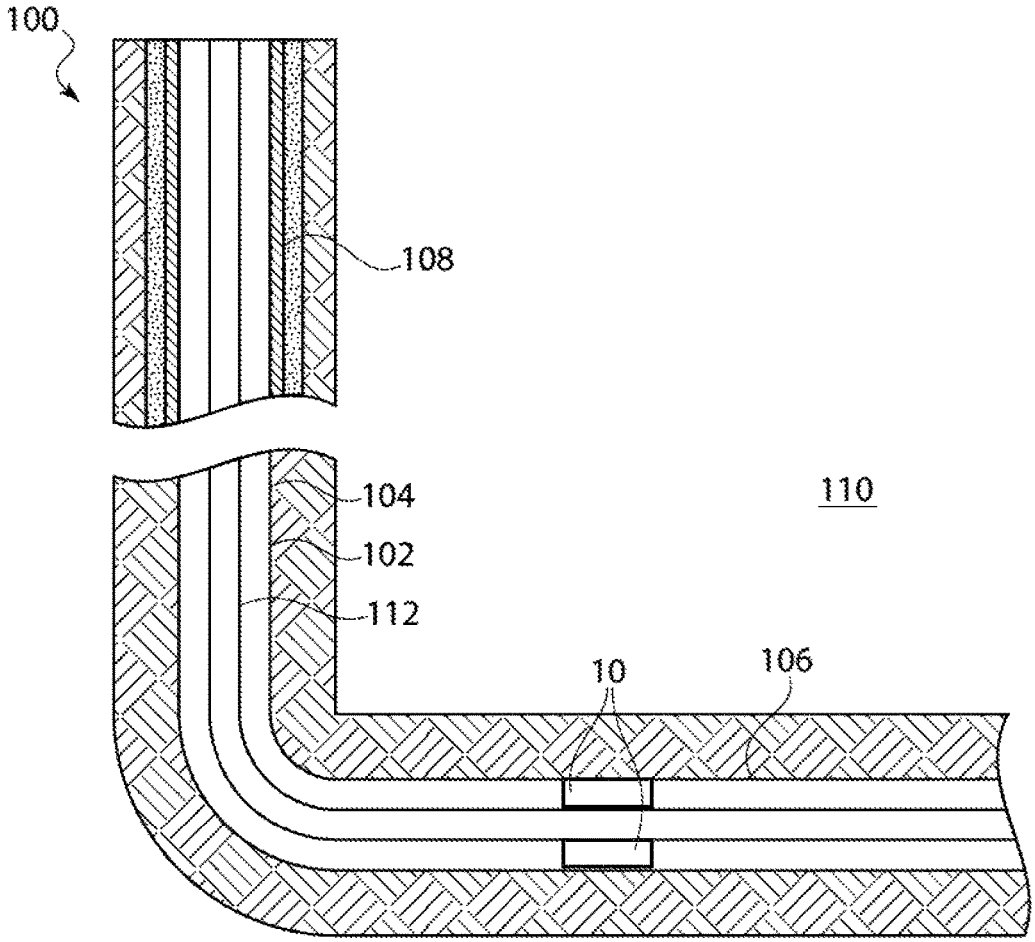
FIG. 1 is a schematic illustration of a well system having a self-assembling packer according to one aspect of the present disclosure.

FIG. 1 schematically depicts a well system 100 with a zone into which a self-assembling packer 10 is to be set. The well system 100 includes a wellbore 102 extending through various earth strata. The wellbore 102 may have a substantially vertical section 104 and a substantially horizontal section 106. The substantially vertical section 104 and the substantially horizontal section 106 may include a casing string 108 cemented at an upper portion of the substantially vertical section 104. The sections 104, 106 may extend through a hydrocarbon bearing subterranean formation 110.

A tubing string 112 within the wellbore 102 extends from the surface to the subterranean formation 110. The tubing string 112 can provide a conduit for formation fluids, such as production fluids produced from the subterranean formation 110, to travel from the substantially sections 104 and/or 106 to the surface. Pressure in the wellbore 102 in the subterranean formation 110 can cause formation fluids, including production fluids such as gas or petroleum, to flow to the surface.

It may be desirable to divide the vertical section 104 and/or the horizontal section 106 into one or more zones, which can be separated by one or more packers. A single zone area is illustrated in FIG. 1, but it should be understood that multiple zones may be provided and are within the scope of this disclosure. A self-assembling packer 10 can be deployed in the wellbore 102. The components (to be described below) of the self-assembling packer 10 can be positioned along the tubing string 112, and are activated to deploy the packer 10 when appropriate. Although FIG. 1 depicts the self-assembling packer 10 in the substantially horizontal section 106, additionally or alternatively, it may be located in the substantially vertical section 104. Moreover, the self-assembling packer 10 described can be disposed in simpler wellbores, such as wellbores having only a substantially vertical section, in open-hole environments, such as is depicted in FIG. 1, or in cased wells. The self-assembling packer 10 may be used in injection wells, water wells, geothermal wells without hydrocarbon, carbon sequestration, monitoring wells, or any other appropriate downhole configuration in combination with any type of injection fluid, such as water, steam, $CO_2$, nitrogen, or any other appropriate fluid.

Figure 2:
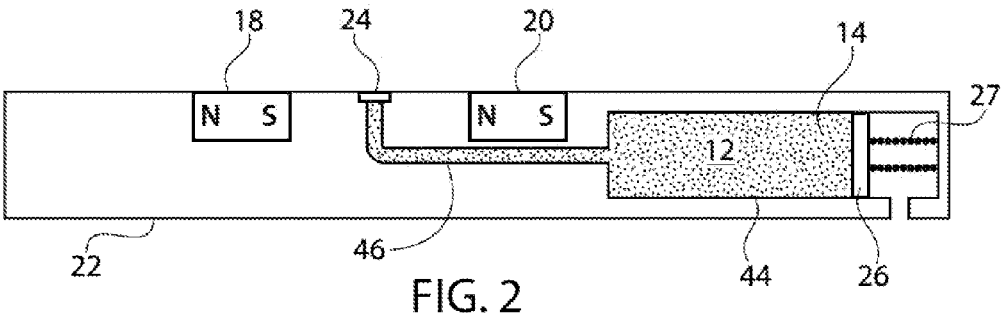
FIG. 2 is a side schematic cross-sectional view of a self-assembling packer according to one aspect of the present disclosure.
Figure 3:
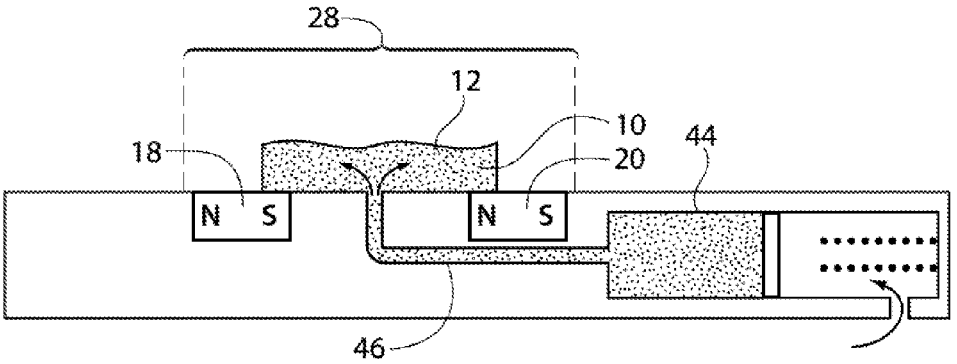
FIG. 3 is a side schematic cross-sectional view of the packer of FIG. 2 with the carrier fluid being deployed.
Figure 4:
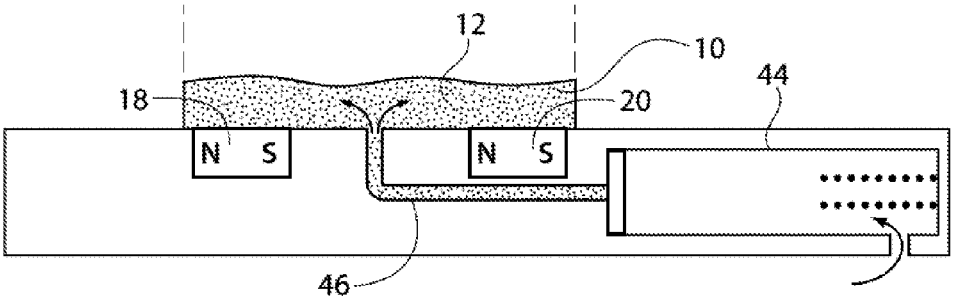
FIG. 4 is a side schematic cross-sectional view of the packer of FIG. 2 with the carrier fluid being held in place by magnets.

In one aspect, the packer may be a self-assembling packer 10 created from a carrier fluid 12 that has its resistance to flow modified via a magnetic field. The carrier fluid may include a combination of a polymer precursor material and magnetically responsive particles 14. The carrier fluid 12 is injected into the annulus between a pair of magnets 18, 20. FIG. 2 schematically depicts the carrier fluid 12 as it may be positioned in tubing 22. FIGS. 3-4 show the packer 10 being formed from the carrier fluid 12.

More specifically, the polymer precursor used to form the carrier fluid 12 is generally a polymer precursor that has magnetically responsive particles 14 combined therewith in order to form a magnetorheological fluid, ferrofluid, or a carrier fluid 12 otherwise having magnetically responsive particles contained therein. First, the polymer precursor that is used may be a material that forms cross-links. Non-limiting examples of polymer precursors that may be used in connection with this disclosure include but are not limited to plastics, adhesives, thermoplastics, thermosetting resins, elastomeric materials, polymers, epoxies, silicones, sealants, oils, gels, glues, acids, thixotropic fluids, dilatant fluids, or any combinations thereof. If the polymer precursor is an epoxy, the epoxy may be a one-part epoxy (e.g., a silicone sealant) or a multi-part epoxy.

The polymer precursor should generally be a material that can carry magnetically responsive particles 14 and cure or otherwise set upon appropriate forces, environmental conditions, or time. The polymer precursor should be a material that can create a seal. The polymer precursor should be a material that can be carried downhole on a tubing string 22 and activated or otherwise mixed downhole. For example, a material that has a requirement of being mixed at the surface and pumped downhole, such as cement, is not preferable. Polymer precursors provide the feature of being deliverable downhole without having to be activated for immediate use. Any other type of polymer precursor or other material that may act as a carrier for magnetically responsive particles 14 and that can cure to form a seal or otherwise act as a sealant is generally considered within the scope of this disclosure.

Second, the polymer precursor is combined with magnetically responsive particles 14 to form the carrier fluid 12. In one aspect, the magnetically responsive particles 14 are nanoparticles that are mixed into the polymer precursor. The mixture may form a slurry. The magnetically responsive particles (which may also be referred to herein as magnetic particles 14 for convenience) may be particles of a ferromagnetic material, such as iron, nickel, cobalt, any ferromagnetic, diamagnetic or paramagnetic particles, any combination thereof, or any other particles that can receive and react to a magnetic force. Any particles that are attracted to magnets can be used in the carrier fluid 12 and are considered within the scope of this disclosure. (It should be noted that the figures are not drawn to scale and for illustrative purposes only. For example, the particles 14 may not be easily visible in the carrier fluid 12 due to their small size, and they have thus been exaggerated in the Figures for ease of viewing.) Any suitable particle size can be used for the magnetically responsive particles 14. For example, the particles may range from the nanometer size up to the micrometer size. In one example, the particles may be in the size range of about 100 nanometers to about 1000 nanometers. In another example, the particles may range into the micrometer size, for example up to about 100 microns. It should be understood that other particles sizes are possible and considered within the scope of this disclosure. In embodiments where the particles are referred to as "nanoparticles," it should be understood that the particles may also be of micron sizes, or a combination of nanoparticles and microparticles. The particles 14 can also be any shape, non-limiting examples of which include spheres, spheroids, tubular, corpuscular, fiber, oblate spheroids, or any other appropriate shape. Multiple shapes and multiple sizes may be combined in a single group of particles 14.

In some aspects, the carrier fluid 12 may be formed in multiple steps. For example, an epoxy may be used that has a two-part set-up (for example, a two-part epoxy), where parts A and B are housed separately from one another and mixed as they pass through a static mixer on their way to the annulus. This aspect allows the carrier fluid 12 to be carried downhole as separate components and mixed immediately prior to use. In another aspect, the magnetically responsive particles 14 may be provided as a separate component to be combined. Alternatively, the magnetically responsive particles 14 may be pre-mixed with one part of the fluid. That one part of the fluid may be combined with a second part of the fluid downhole, prior to delivery of the carrier fluid 12 as described below. In other words, the various components of the carrier fluid 12 may be combined prior to or upon dispensing. Additionally or alternatively, the various components of the carrier fluid 12 may by run downhole in a pre-combined condition.

The tubing 22 contains the carrier fluid 12 therein. In one aspect, the carrier fluid may be housed in a housing 44 with a delivery conduit 46. The housing 44 may house the carrier fluid 12 in a pre-combined condition. Alternatively, the housing 44 may be designed to maintain parts A and B of carrier fluid 12 separately until just prior to deployment of the carrier fluid 12. For example, there may be provided a divider wall within housing 44 to maintain parts of the polymer precursor of the carrier fluid 12 separate from one another.

Passage of the carrier fluid 12 through a magnetic field causes the magnetically responsive particles 14 to align with the magnetic field. The magnetic field may be created by one or more magnets 18, 20. The term "magnet" is used herein to refer to any type of magnet that creates a radially extending magnetic field, and includes but is not limited to disc magnets, ring-shaped magnets, block magnets, or any other type of closed shape magnet. It is desirable for at least a portion of the magnetic field to extend radially from the magnets 18, 20. In a particular aspect, the magnets project a magnetic field outwardly of the outer diameter of the tubing 22.

Alignment of the magnetically responsive particles 14 with the magnetic field of the magnets 18, 20 causes the magnetic particles 14 to hold the carrier fluid 12 between magnets. Subsequent movement of the carrier fluid 12 is limited due to arrangement of the particles 14. FIG. 2 shows first and second permanent magnets 18, 20 that are positioned along tubing 22. The north and south polarities are shown for non-limiting illustrative purposes only and may be changed. The tubing 22 may be part of a string of tools run into the borehole.

The magnets 18, 20 may be positioned on the inner diameter of tubing 22, to the outer diameter of the tubing 22, embedded in the tubing, run down on a separate tool, or provided in any other configuration. The magnets 18, 20 may be attached or otherwise secured to the tubing via any appropriate method. Non-limiting examples of appropriate methods include adhesives, welding, mechanical attachments, embedding the magnets within the tubing, or any other option. Additionally, although two magnets 18, 20 are shown for ease of reference, it should be understood that magnets 18, 20 may each be a ring magnet positioned around the circumference of tubing. Magnets 18, 20 may be a series of individual magnets positioned in a ring around tubing 22. The general concept is that magnets 18, 20 form a magnetic space therebetween that extends radially from the tubing 22. The magnetic space extends past the outer diameter of the tubing.

Figure 6:
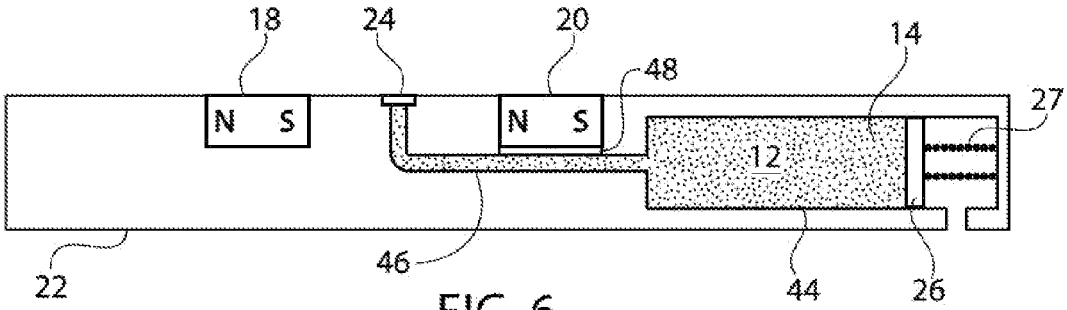
FIG. 6 shows the self-assembling packer of FIG. 2 with a shunt positioned to prevent premature magnetization of magnetically responsive particles in the carrier fluid.

In additional or alternative aspects, a shunt 48 or other blocking feature may be positioned adjacent to the magnet 20 past which the carrier fluid 12 flows during deployment. In a particular embodiment as shown in FIG. 6, the shunt 48 may be positioned between the magnet 20 and the conduit 46 such that it is between the flow path of the carrier fluid 12 and the magnet 20. This helps ensure that the magnetic field of magnet 20 force does not act on carrier fluid 12 until it is deployed as described below. The shunt 48 can prevent the movement of carrier fluid 12 from slowing prior to deployment. The shunt 48 may further prevent the magnetic particles from being prematurely magnetized prior to injection into the annulus. The shunt 48 may be secured to the upper area of conduit 46, secured to a lower area of magnet 20, or positioned in any other location that can allow it to act as a magnetic shunt to block the magnetic field. In a further option, a shunt may be provided placed between one or more of the permanent magnet(s). The shunt may be used to prevent the magnetic field from solidifying the carrier fluid 12 in its flow path. For example, the movement of carrier fluid 12 may be slowed due to a force from magnet 20 that is positioned adjacent to conduit 46. Providing a shunt 48 at or near this location can prevent a magnetic force from magnet 20 from acting on the carrier fluid 12 prior to deployment.

The general intent of shunt 48 is to prevent premature magnetization of carrier fluid 12. Shunt 48 can prevent the magnetic force from reaching carrier fluid 12 until the desired point.

The shunt may also be positioned where the carrier fluid 12 flows once outside tubing in order to diminish the magnetic field in the annulus. This could diminish the holding pressure from the magnets 18, 20, which act as seals for the carrier fluid 12. This can be compensated by making a magnet longer in the region proximate the shunt in order to create a longer region of magnetic field. Alternatively, the driving force applied to the drive piston may be sufficiently strong such that solidified fluid is expelled past the magnet. Constructing the flow passage conduit 46 with an expanding taper may also ease driving of any solidified fluid past the magnet-bounded area.

At the end of conduit 46 and between the magnets 18, 20 is a component on the tubing section 22 to contain the carrier fluid 12 until deployment. In one aspect, this component may be a rupture disc 24. The carrier fluid 12 is forced to flow through and break the rupture disc 24 when pressure is applied to the disc 24.

FIG. 3 shows a side schematic cross-sectional view of the packer of FIG. 2 with the carrier fluid 12 being deployed by interior pressure. As shown, pressure is applied to the carrier fluid 12 via a drive piston 26 or any other component or force that can apply pressure to the carrier fluid 12. The piston 26 may have a spring 27 engagement that causes movement of the piston 26 when activated. The spring 27 is used to keep the piston 26 in contact with the fluid(s) 12 to ensure that that the carrier fluid 12 does not get contaminated by wellbore fluids. This may prevent the carrier fluid 12 from prematurely setting. When applied, pressure causes the carrier fluid 12 to rupture the rupture disc 24 and exit through the resulting opening created. Rupture disc 24 is provided to prevent premature application of the fluid into the annular space 28.

More specifically, the spring 27 can exert a force on the piston 26 in the direction of the carrier fluid 12. The force exerted on the piston 26 can cause the piston 26 to exert a force on the carrier fluid 12 in the direction of the rupture disc 24. Until ruptured, the rupture disc 24 remains closed and can exert a force on the carrier fluid 12 in a direction opposite the force exerted by the piston 26. Once the force exerted on the carrier fluid 12 exceeds the force of the rupture disc 24, the rupture disc 24 is caused to rupture. Rupturing of the rupture disc 24 removes the force exerted by the rupture disc 24 on the Carrier fluid 12. This allows the carrier fluid 12 to flow into the space 28 in response to the force exerted by the piston 26.

In one aspect, the rupture disc 24 may be a small piece of foil, metal, or other material that contains the carrier fluid 12 until pressure is applied. In another aspect, the rupture disc may be a dissolvable plug that dissolves upon a certain pH environmental, or otherwise ceases to contain the carrier fluid 12 in response to a pre-selected trigger. For example, the rupture disc 24 may be formed as a temperature sensitive material or shape memory material plug that dissolves upon a certain temperature, shrinks or enlarges at a certain environmental condition, or otherwise ceases to contain the carrier fluid 12 in response to a pre-selected trigger. For example, the dissolving of plug could cause the piston 26/spring 27 to push the carrier fluid 12 out the created opening.

The carrier fluid 12 is generally viscous or syrup-like so that it has flow and movement properties. The carrier fluid 12 may have a minimum yield stress before it flows, such as Bingham plastic, and it may behave as a thixotropic material, such as a gel. The carrier fluid 12 remains in a moveable form until it reaches the magnetic field or magnetic space. These figures show an active deployment, in that the carrier fluid 12 is forced to exit through rupture disc 24 upon the application of pressure to piston 26. It should be understood that a passive deployment is also possible.

For example, the fluid may be in a dissolvable or rupturable bag that is passively deployed and then attracted toward magnets to allow the fluid to disperse into the annulus.

Figure 5:
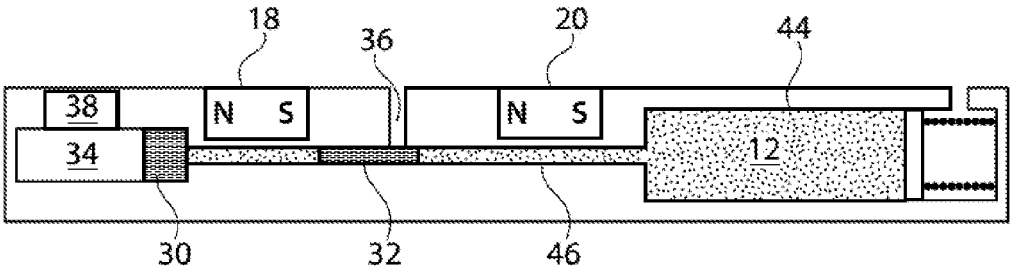
FIG. 5 is a side schematic cross-sectional view of a powered deployment of the carrier fluid.

Instead of using a pressure differential across the completion to move/deploy the carrier fluid 12, an electronically triggered system may be used to activate the release of the fluid. FIG. 5 is a side schematic cross-sectional view of a powered deployment of the carrier fluid 12.

For example, an electronic rupture disc 30 may be used to hold a blocking piston 32 in place. Electronic removal of the blocking piston 32 allows the fluid to fill the annulus and to create the annular seal. Upon activation, the blocking piston 32 generally moves back to allow the carrier fluid 12 to move forward and up through opening 36. The electronics 38 may be housed in an accompanying electronics and battery space 34 near the piston 32 to create the desired electronic activation when desired. In one aspect, a wireless signal to the electronics can be generated. The signal may be based on the pressure rise from screen out of the gravel pack, tubing movement, pressure cycles, temperature changes, dropping a ball that has magnetic properties, dropping a ball that emits a wireless signal, an acoustic signal, or any other activating event.

Referring now to FIGS. 2-4, as the carrier fluid 12 flows out from the rupture disc 24, the magnetically responsive particles 14 are attracted by the magnets 18, 20 as shown in FIGS. 3 and 4. If an initial flow is biased toward one side (e.g., toward the left toward magnet 18), the magnetic action from the other side (e.g., from the right side magnet 20) may cause the fluid to move back toward a centralized position between the magnets. The interaction between the particles 14 and the magnets 18, 20 causes the carrier fluid 12 to fill the space 28 between the magnets 18, 20 without moving very far past the desired space.

The halted movement of the carrier fluid 12 allows it to create a packer 10 between the tubing 22 and the subterranean formation 110. Flowing carrier fluid 12 has its particles held by the magnetic force or field being exerted. The magnetic force changes the shear strength of the fluid from viscous to having a lower viscosity or to be more solid-like. This causes the carrier fluid 12 to stop flowing and to generally remain in space 28. Once formed, the carrier fluid 12 is allowed to cure or harden or otherwise create a seal. The polymer precursor material may begin to cross-link and cure. For example, the passage of time, applied heat, and/or exposure to certain fluids or environments causes the carrier fluid 12 to set and/or cure to form a packer 10 in the desired location. For example, a elastomeric carrier may cure via vulcanization. A one-part epoxy may cure after a time being exposed to the well bore fluids. A silicone sealant could be used as a one-part epoxy which sets and cures with exposure to water. A slow setting gel or other gel may set in the presence of water. Two-part systems generally cure due to a chemical reaction between the components to the two parts upon mixing. Other carriers/sealants may be used that cure based on temperature or any other environmental cue.

The packer 10 may generally be referred to as "self-assembling" because it forms without hydraulic force or other forces typically used to set packers. All that is required is pressure to the carrier fluid 12 to cause deployment, and the magnets 18, 20 cause a packer 10 to form generally therebetween. The magnetic force from the pre-set permanent magnets can create the magnetic force or field that causes the fluid to solidify, stop flow, and form a packer in use. The force required to set the packer 10 is minimal compared to the large differential pressures it can withstand.

The present disclosure provides a self-assembling packer 10 in which the carrier fluid 12 is held in the tubing 22 and is allowed to free-flow directly into the annular space 28 via the rupture disc 24 upon application of pressure. This also allows the packer 10 to be set in granular or other debris-filled environments. The carrier fluid 12 can flow into the formation 110. Additionally, the magnetic field is created by permanent magnets. While an electromagnet could be used to provide the magnetic field, it is not necessary. Using two magnets 18, 20 can allow the shape of the packer to be adjustable via providing various magnet positions along the tubing 22.

If the magnetic field is increased, the carrier fluid 12 may become increasingly solid. If the magnetic field is removed, the carrier fluid 12 may resume a more fluid-like or viscous-like state. This is generally the case with the carrier fluid 12 before the carrier has begun to harden or otherwise create a seal.

FIG. 4 is a side schematic cross-sectional view of the packer 10 with the carrier fluid being held in place by magnets 18, 20. As shown, once the carrier fluid 12 has exited the tubing 22 to fill the available volume of the desired annular space 28, the carrier fluid 12 is halted from moving further by magnetic action. The placement and location of the magnets 18, 20 can be altered as desired to create the desired length of the packer 10 that self-forms. In one aspect, the magnets 18, 20 may act like cup packers and keep the carrier fluid 12 in the sealing section. The carrier fluid 12 is trapped by the magnets 18, 20. The trapped carrier fluid 12 is caused to fill the space between the magnet packers sufficiently before it is displaced beyond the magnets.

Although shown and described with two magnets 18, 20 (or a series of two rows of magnets that generally create a magnetic field therebetween), it is possible for this system to be deployed with a single magnet. For example, a vertical assembly may have a single magnet. The fluid may flow down via natural gravity, and a lower magnet may be used to constrain the carrier fluid's flow due to gravity and thus maintain the carrier fluid is the desired location. A single magnet 20 could be used to cause a packer 10 to form above the magnet 20 if the carrier fluid 12 is significantly more dense than the wellbore fluid, such as if the wellbore fluid is a gas and the carrier fluid is a liquid. Alternatively, a single magnet 18 could be used to cause a packer 10 to form below the magnet if the carrier fluid is significantly less dense than the wellbore fluid, such as if the wellbore fluid is a heavily weighted mud. The same option may work horizontally. In one aspect, if a Newtonian fluid is used as the carrier fluid, a series of single magnets could be used. More specifically, the trapped volume between a pair of magnets would not necessarily aid the sealing with a Newtonian carrier fluid, so providing a series of single magnets may help control flow. It is also possible to use a directing jet at or near the rupture disc 24 that can be angled to guide the flow of the fluid. This may cause a more specified stream of carrier fluid 12 to be directed in the desired direction. This can be useful with less viscous fluids.

In some aspects, the subterranean formation 110 can be permeable. The carrier fluid 12 with particles 14 may enter a short distance into the permeable formation 110. This can extend the seal provided by the packer 10 beyond the annulus and into the formation 110. Creating such a seal into the formation may help decrease the likelihood of bypassing the self-assembling packer. A packer 10 that creates a deep seal that extends into the formation can accommodate a shorter packer than a normal swell packer. Additionally, any displaced or over displaced fluid that passes to another side of the magnet may simply extend the sealing length, which can also help secure the packer 10.

The pressure holding capability of the nano-structured, self-assembling packer 10 can vary depending on how the seal is constructed. If the carrier fluid is a setting epoxy, then the packer 10 may support a larger pressure differential than if the carrier fluid is silicone oil. These parameters may be modified depending upon the desired use and pressure requirements. Additionally, the pressure capabilities of the magnetic packers at the end of the sealing section can be calculated. The differential pressure ΔP that the solution of ferromagnetic particles can hold can be provided by the function $$\Delta P = \frac{3\tau_y L}{g}$$

where $\tau_y$ is the shear strength of the energized fluid and L is the length of a magnet or a length of a tubing section with a high magnetic field. A non-limiting example of shear strength $\tau_y$ may be approximately eight psi. A non-limiting example of a length of L may be about two inches. The gap between each side of the packer and the formation is represented by g, which may be about 0.25 inch. For a shear strength $\tau_y$ of eight psi and a length L of two inches, a nanoparticle solution can build up at least 190 psi pressure within the sealing section before the fluid would bypass the magnet packers. This differential pressure will ensure that there is a sweep of the fluids within the sealing section.

The pressure holding capability of the overall packer can depend on the setting of the epoxy or other polymer precursor material used in the carrier fluid 12, as well as on the length of the self-assembling packer. For example, the shear strength of silicone sealant (about 220 psi) can be substituted into the above equation. The calculation indicates that silicone sealant would have a pressure holding capability of 2000 psi per inch of length. There will still be a significant pressure differential even after de-rating the pressure holding capability for poor bonding, contamination by the wellbore fluid, dilution to increase uncured flow-ability, and other undiscovered effects. If deployed in a gravel pack or other debris-filled environment, the gravel/proppant has the potential to increase the pressure differential due to the gravel/proppant taking some of the load. However, the proppant also has the potential to decrease the pressure differential due to poor adhesion between the sealant and the proppant. Accordingly, the formula calculations show that a useful pressure-holding capability can be produced from a reasonable volume of magnetic particle-laden sealant.

Further aspects, alternate options, and possible alterations to the above-disclosure are also possible. For example, the carrier may be selected so that it has self-healing properties that will provide a self-healing packer element. For example, silicone sealants have been shown to have self-healing properties. Carrier fluids that set into a self-healing material may be advantageous for repairing damage from over-flexing, over-pressurization, tubing movement, and so forth. Self-healing can further be accomplished by adding an encapsulated healing agent and catalyst into the mix. Crack formation would rupture the encapsulated healing agent which would seal the crack. Using hollow glass fibers may also provide a self-healing packer element. In another alternative, small particles may be added to the gravel pack. The small particles are small enough to pass through the gravel pack, but they are large enough to be stopped at the energized solution of nanoparticles. Thus, if the magnetic packer leaks, then the small particles may help would plug the leak.

In the above-described aspects, deployment of the carrier fluid 12 is by forcing the fluid into the annulus via the interior pressure. Alternatively, the carrier fluid 12 solution of particles could be encased in a dissolvable bladder or bag. When the bladder dissolves or degrades, the particles may be attracted toward the magnets. The carrier fluid 12 particle solution can be encased in a water-dissolvable case with a material like polyglycolic acid (PGA), polylactic acid (PLA), salt, sugar, or other water-dissolvable (or other solution-dissolvable, such as acid or brine contact) material. The reactions could be triggered by contact with water, acid, or brine solution. Additionally or alternatively, the carrier fluid 12 particle solution can be encased in a temperature-degradable case with a material such as a fusible metal, a low-melt thermoplastic, or an aluminum or magnesium case that would galvanically react in the water. Applied voltages may be used to cause the galvanic reaction to happen nearly instantaneously and/or voltage could be used to delay the galvanic reaction.

In the concepts previously discussed, the magnetically responsive particles 14 and the carrier fluid 12 are both carried downhole with a tool such as tubing 22. In another embodiment, the solution of magnetically responsive particles 14 could be circulated separately. For example, in an enhanced single-trip multizone completion (ESTMZ) operation, the annulus could be flushed with a solution of magnetically responsive particles in order to make the seal. The magnetically responsive particles may be caused to flow through the gravel until they reach the magnets. The magnet packers may then hold the magnetically responsive particles in place and that structure can then be concentrated with the diluted solution.

The packer system discussed in the above disclosure is generally designed to be a permanent set packer. However, if the carrier fluid 12 is chosen to have minimal yield strength when set, then the self-assembling packer can be made into a retrievable packer. In one aspect, the permanent magnets 18, 20 can be short circuited with a ferroshunt on the interior of the tubing 22. In another aspect, the permanent magnets could be canceled with another permanent magnet or with an electromagnet on the interior of the tubing 22.

Varying the magnetic field may also allow for an alternative deployment of the carrier fluid 12. In one variation, there may be a lower magnetic field during deployment of the carrier fluid. With less magnetic flux, the carrier fluid is less constrained and flows more easily. As a result, the carrier fluid is more likely to penetrate deeper into the formation 110 and to create a zonal isolation that is deeper than the annulus to be sealed. This may be accomplished via varying the magnetic field using any appropriate method. In a further variation, there may be a stronger magnetic field in place during the deployment of the carrier fluid.

In a further alternate embodiment, instead of using magnets to hold magnetically responsive particles in place, an electric field and a dispersion of nanoscale suspended particles may be used. In this embodiment, this fluid would also be known as an electrorheological fluid (ER fluid). This approach would use electrical packers composed of a DC electric field rather than magnetic packers to contain the solution of electrical particles within the sealing section. The electrical operation may be compatible with the magnetic operation, such that the systems are used in tandem. For example, a solution of ferromagnetic nanoparticles as well as electrical nanoparticles could be used.

Various modifications to the fluid can be made in order to minimize settling of the particles in the carrier fluid. Iron particles are generally heavier than epoxy, but for example, if the carrier fluid is chosen to have a similar density to the particles, settling or early solidifying of the particles can be minimized. A yield stress within the carrier fluid can also help to minimize settling. Settling can be minimized by one or more of using smaller particle sizes, sending the solution of particles through a static mixer during the injection process, and/or mixing a highly concentrated solution of particles with the carrier fluid during the injection process. Use of a highly concentrated solution with a high yield strength may help prevent settling of the particles; the carrier fluid may dilute the high yield strength to allow for easier flow through the gravel pack and into the formation. Agglomeration of the particles can be minimized by using a dispersant or surfactant, such as soap, in the fluid. The surface of the particles may be funcationalized, such as with siloxane, in order to enhance the bonding between the particles and the crosslinking carrier fluid.

The performance of the magnets can be enhanced by creating a situation where there is compressive locking of the particles. Tapering the exterior of the tool at the magnet portions may help to form a compressive lock within the particles.

The shape of the actual particles may be altered in an effort to create better internal locking of the particles. For example, round particles may be used. However, elongated or rod-shaped particles may lock more securely and create a stronger packer in place. The particles can be shaped to better entangle with one another to form the packer. The length of the particles may also be modified to provide varying locking configurations. It is believed that a particularly useful length may be from about 10 nanometers to about 1 millimeter, although other options are possible and within the scope of this disclosure.

In summary, there is provided a self-assembling packer for use downhole in a wellbore, comprising: a tubing section containing a carrier fluid comprising a polymer precursor and magnetically responsive particles; one or more magnets positioned on or within the tubing section, the one or more magnets bordering a space and creating a radially extending magnetic field; a component on the tubing section to contain the carrier fluid until deployment; and a component to cause deployment of the carrier fluid into the space to be filled; wherein a magnetic field from the one or more magnets is operable for directing the carrier fluid to fill the space. The carrier fluid may create a self-assembling packer upon cure of the polymer precursor. In a certain aspect, the carrier fluid is a sealant. The magnets may be ring magnets, bar magnets, two series of bar magnets that are secured to or within the tubing section (e.g., one series of bar magnets may be adjacent to a first side of the rupture disc or other component on the tubing section to contain the carrier fluid until deployment, and a second series of bar magnets may be adjacent to a second side of the rupture disc or other component on the tubing section to contain the carrier fluid until deployment).

There is also provided a method for constraining a sealant to create a downhole packer, comprising: providing a radially extending magnetic force field from a tubing section; providing a magnetorheological fluid with a carrier component that cures to form a sealant;

dispensing the magnetorheological fluid such that the magnetorheological fluid is constrained by the magnetic force field, allowing the fluid to cure to form a packer. Aspects further relate to use of a magnetorheological fluid comprising a polymer precursor delivered in two components into a downhole environment, wherein mixing of the two components forms a carrier fluid, and wherein movement of the carrier fluid is constrained by a radially extending force field.

The foregoing description, including illustrated aspects and examples, has been presented only for the purpose of illustration and description and is not intended to be exhaustive or to limiting to the precise forms disclosed. Numerous modifications, adaptations, and uses thereof will be apparent to those skilled in the art without departing from the scope of this disclosure.

What is claimed is:

1. A self-assembling packer for use downhole in a wellbore, comprising:

a tubing section containing a carrier fluid comprising a polymer precursor and magnetically responsive particles;

one or more magnets positioned on or within the tubing section, the one or more magnets bordering a space and creating a radially extending magnetic field;

a component to cause deployment of the carrier fluid into the space to be filled;

wherein a magnetic field from the one or more magnets is operable for directing the carrier fluid to fill the space, wherein the carrier fluid is delivered through a conduit and further comprising a shunt between the conduit and at least one of the one or more magnets.

2. The self-assembling packer of claim 1, further comprising a component on the tubing section to contain the carrier fluid until deployment.

3. The self-assembling packer of claim 2, wherein the component on the tubing section to contain the carrier fluid until deployment comprises a rupture disc.

4. The self-assembling packer of claim 1, wherein the carrier fluid creates a self-assembling packer upon cure of the polymer precursor.

5. The self-assembling packer of claim 1, wherein the carrier fluid is a sealant.

6. The self-assembling packer of claim 1, wherein the polymer precursor of the carrier fluid comprises at least one of a plastic, adhesive, thermoplastic, thermosetting resin, elastomeric material, polymer, epoxy, silicone, sealant, gel, glue, acid, thixotropic fluid, dilatant fluid, or any combination thereof.

7. The self-assembling packer of claim 1, wherein the magnetically responsive particles comprise nanoparticles.

8. The self-assembling packer of claim 1, wherein the magnetically responsive particles comprise at least one of iron, nickel, cobalt, diamagnetic particles, paramagnetic particles, or any combination thereof.

9. The self-assembling packer of claim 1, wherein the carrier fluid comprises a silicone and wherein the magnetically responsive particles comprise iron nanoparticles.

10. The self-assembling packer of claim 1, wherein the one or more magnets comprise ring magnets.

11. The self-assembling packer of claim 1, wherein the one or more magnets comprise two series of bar magnets that are secured to or within the tubing section, one series of bar magnets adjacent to a first side of the component on the tubing section to contain the carrier fluid until deployment, and a second series of bar magnets adjacent to a second side of the component on the tubing section to contain the carrier fluid until deployment.

12. The packer of claim 3, wherein the rupture disc comprises rupture disc comprises at least one of foil, metal, a dissolvable plug, a temperature sensitive plug, a shape memory plug, a plug that shrinks or enlarges at a certain environmental condition, or a combination thereof.

13. The packer of claim 1, wherein the component to cause deployment comprises a pressure delivering component.

14. The packer of claim 13, wherein the pressure delivering component comprises a piston.

* * * * *